US006430389B1

(12) United States Patent
Kimura

(10) Patent No.: US 6,430,389 B1
(45) Date of Patent: Aug. 6, 2002

(54) PICTURE IMAGE FORMING SYSTEM WITH STAPLER

(75) Inventor: Kazuhisa Kimura, Hiratsuka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/697,490

(22) Filed: Oct. 27, 2000

(51) Int. Cl.[7] ..... G03G 15/00
(52) U.S. Cl. ..... 399/410; 399/407; 399/81
(58) Field of Search ..... 399/81, 407, 408, 399/410

(56) References Cited

U.S. PATENT DOCUMENTS 4,816,866 A * 3/1989 Yamada ..... 399/81

FOREIGN PATENT DOCUMENTS

JP 7-89256 4/1995

JP 10-67461 3/1998

* cited by examiner

*Primary Examiner*—Sophia S. Chen
*Assistant Examiner*—Hoang Ngo
(74) *Attorney, Agent, or Firm*—Foley & Lardner

(57) ABSTRACT

A picture image forming system has a large and conspicuous display of stapling positions and thereby helps prevent an erroneous stapling position from being selected. The picture image forming system includes a picture image forming system body for forming a picture image on the basis of an inputted picture signal and for reading image data including the orientation and size of an original to be copied, using a picture image reader. The picture image forming system also includes an operating part for displaying a picture image of only one type of original so as to include a vertical or horizontal orientation and for displaying a plurality of selectable stapling positions on the picture image of only one type of original in layers. The operating part reads one or more stapling positions selected from the plurality of selectable stapling positions. The picture image forming system further includes a stapler for binding a plurality of copied sheets on the basis of information about the selected stapling positions.

8 Claims, 8 Drawing Sheets

PICTURE IMAGE FORMING SYSTEM WITH STAPLER

BACKGROUND OF THE INVENTTON

1. Field of The Invention

The present invention relates generally to a picture image forming system and a stapling method for use therein.

2. Related Background Art

Some picture image forming systems are provided with a stapler for binding a bundle of copied sheet materials. Usually, such a picture image forming system with a stapler can select a stapling position of a bundle of copied sheet materials. As such a selecting means of a conventional typical picture image forming system, the picture images of a plurality of sheet materials of different types, together with their stapling positions, have been displayed on a single screen so that an operating part can select a desired one from the displayed types of sheet materials. FIG. 9 shows an example of an operating part of a conventional picture image forming system. In this example, the picture images of five kinds of sheet materials are simultaneously displayed on a display screen of the operating part, and a desired one is selected from the displayed picture images of the sheet materials to determine a stapling position.

However, in such a conventional picture image forming system, the display of the operating part is small and illegible (see FIG. 9), often leading to the selection of an erroneous stapling position.

SUMMARY OF THE INVENTION

It is therefore an object of the present invention to eliminate the aforementioned problems and to provide a picture image forming system capable of preventing an erroneous stapling position from being selected, and a stapling method for use therein.

In order to accomplish the aforementioned and other objectives, according to one aspect of the present invention, a picture image forming system comprises: a picture image forming system body for forming a picture image on the basis of an inputted picture signal and for reading image data including the orientation and size of an original to be copied, using a picture image reader; an operating part for displaying a picture image of only one type of original so as to include a vertical or horizontal orientation and for displaying a plurality of selectable stapling positions on the picture image of only one type of original in layers, the operating part reading one or more stapling positions selected from the plurality of selectable stapling positions; and stapler for binding a plurality of copied sheets on the basis of information about the selected stapling positions.

According to another aspect of the present invention, there is provided a stapling method for use in a picture image forming system, the stapling method comprising: a first step of reading image data including the orientation and size from an original to be copied, using an image reader of a picture image forming system; a second step of displaying a picture image of only one type of original so as to include a vertical or horizontal orientation and of displaying a plurality of selectable stapling positions on the picture image of only one type of original in layers; and a third step of stapling a plurality of copied sheets using a stapler on the basis of information about a selected stapling position.

BRIEF DESCRIPTION OF THE DRAWINGS

The present invention can be understood more fully from the detailed description given herebelow and from the accompanying drawings of the preferred embodiments of the invention. However, the drawings are not intended to imply limitation of the invention to a specific embodiment, but are for the purpose explanation and clarification of understanding only.

In the drawings.

DESCRIPTION OF THE PREFERRED EMBODIMENTS

Referring now to the accompanying drawings, the preferred embodiments of the present invention will be described below.

Figure 1:
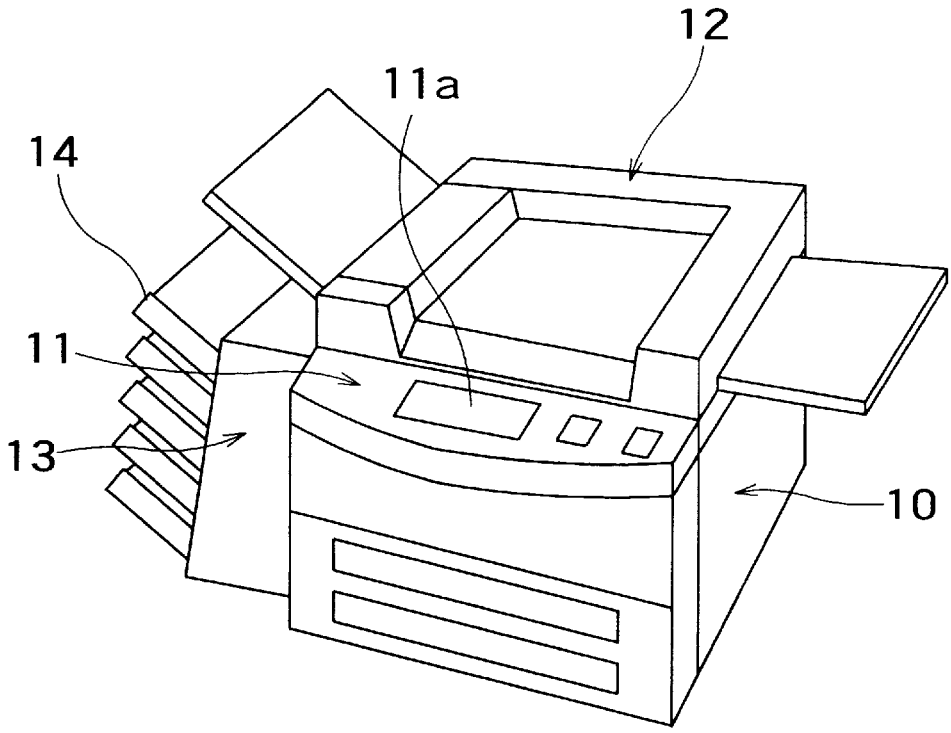
FIG. 1 is a perspective view showing the entire construction of a preferred embodiment of a picture image forming system according to the present invention.

FIG. 1 is a general view of a picture image forming system according to the present invention. In the diagram, reference number 10 denotes a picture image forming system body, 11 denotes an operating part (control panel), and 11*a* denotes a display part of the operating part. An operator can set copying conditions via of the operating part. Reference number 12 denotes an automatic document feeder. The automatic document feeder 12 is designed to automatically feed a plurality of originals to be copied to the picture image forming system body 10. Reference number 13 denotes a stapler, and 14 denotes a sorter part. The stapler 13 is designed to bind a bundle of copied sheets on the basis of information which has been set by the operator using the operating part. The sorter part 14 has so-called sorting and stacking functions with respect to the bundle of copied sheets.

Figure 2:
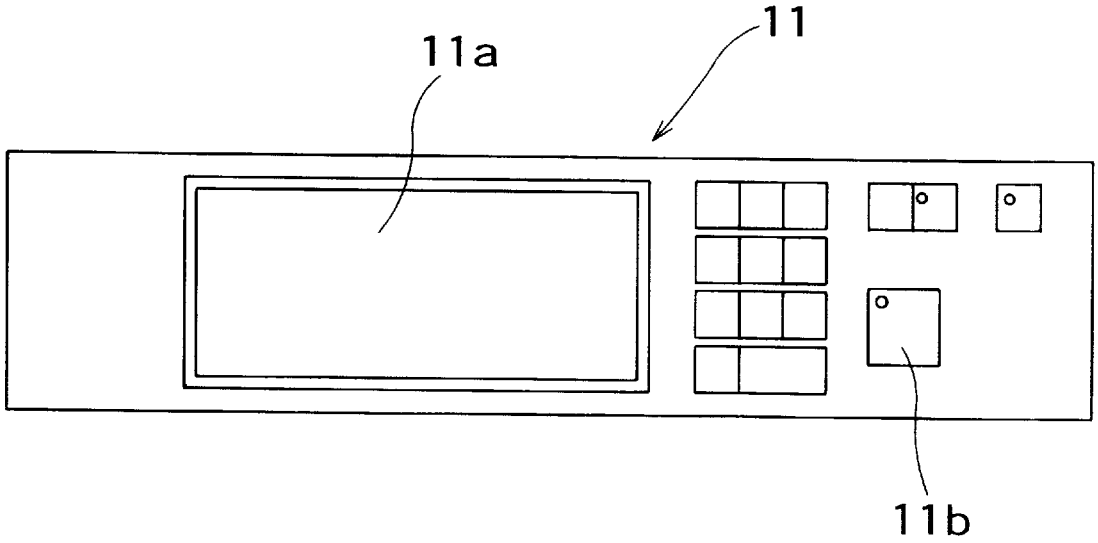
FIG. 2 is an enlarged view of an operating part of the preferred embodiment of a picture image forming system according to the present invention.

FIG. 2 is an enlarged view of the operating part 11. In the figure, reference number 11*a* denotes the display part, and 11*b* denotes a start button. The picture image forming system in this preferred embodiment is characterized in that the picture image of only one original, which includes its vertical and horizontal orientations, is displayed and that a plurality of selectable stapling positions are displayed on the picture image of the original in layers.

Two kinds of picture image forming systems having different operating parts will be described below.

First Preferred Embodiment

Figure 3:
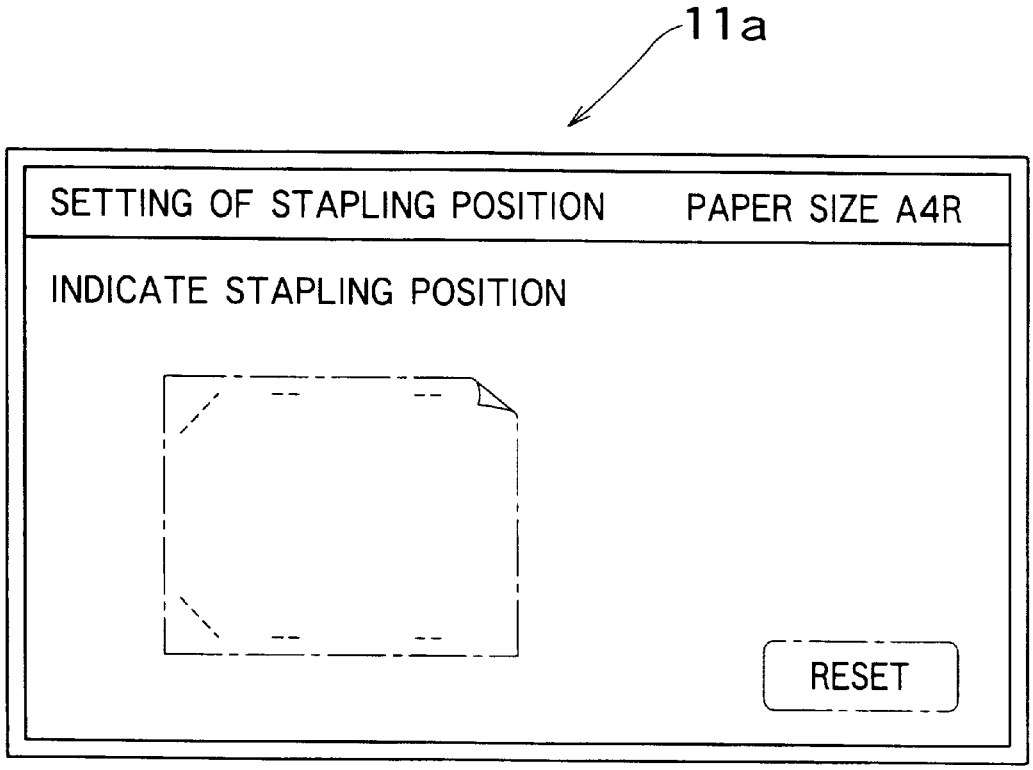
FIG. 3 is a schematic diagram showing a display part of an operating part of the first preferred embodiment of a picture image forming system according to the present invention.
Figure 4:
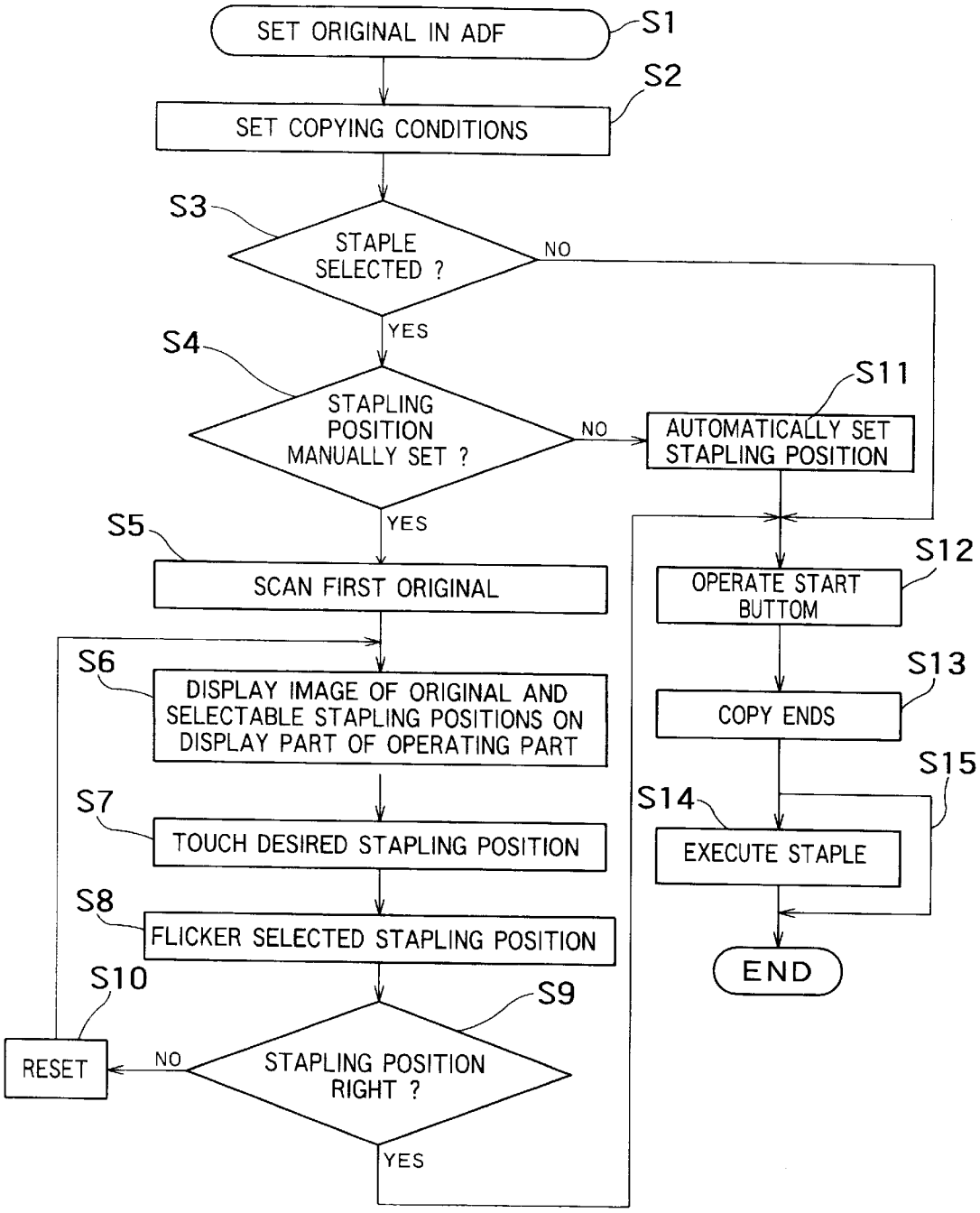
FIG. 4 is a flow chart for explaining a stapling-position selecting operation in the first preferred embodiment of a picture image forming system according to the present invention.

FIG. 3 shows a display part of an operating part of the first preferred embodiment of a picture image forming system according to the present invention. In the picture image forming system in this preferred embodiment, the automatic document feeder (ADF) takes a first original in, and then, the image reader of the picture image forming system body reads image data including the orientation and size of the original. Then, on the basis of the image data, the display part displays the picture image of the original including a plurality of selectable stapling positions as shown in FIG. 3. In the picture image forming system in this preferred embodiment, the picture image of only one original, the stapling positions of which should be displayed and which includes its vertical and horizontal orientations, is displayed (FIG. 3), so that the display of the stapling positions is larger and more conspicuous than that of the conventional example (FIG. 9) in which a plurality of sheet types are displayed. In addition, the picture image forming system in this preferred embodiment is easy to handle without erroneously setting the orientation and size of the original since they are automatically displayed on the display part. The operator selects a desired stapling position from the plurality of selectable stapling positions referring to the picture image of the original.

Referring to the flow chart of FIG. 4 and FIGS. 1, 2, 3 and 5, a stapling-position selecting operation in the picture image forming system in this preferred embodiment will be described below.

(1) First, an original is set in the automatic document feeder (ADF) 12 (S1).

(2) Then, copying conditions, such as number of copies, a scale and a sorter selection, are set by the operating part 11 (S2).

(3) When the above described copying conditions are set, whether a stapling operation is intended to be carried out it is also selected (S3). When no stapling operation is intended to be carried out, the start button 11*b* is pushed to start a copying operation (S12). In this case, after the copying operation is completed (S13), the stapling operation (S14) is not carried out, and the routine ends (S15).

(4) Then, the operator selects whether a stapling position is intended to be set manually (S4). If the stapling position is not manually, the stapling position is automatically set (S11). Thereafter, the start button 11*b* is pushed to start a copying operation (S12).

(5) Then, the automatic document feeder 12 takes the first original in, and the image reader of the picture image forming system body 10 reads image data including the orientation and size of the original (S5). This image reader is the same as that used when reading the original during the copying operation, and may be a well-known image reader.

(6) Then, on the basis of the read image data, the picture image of only one original, which includes vertical and horizontal orientations, is displayed on the display part 11*a* of the operating part 11, and a plurality of selectable stapling positions are displayed on the picture image of the original in layers (S6, FIG. 3).

Figure 5A:
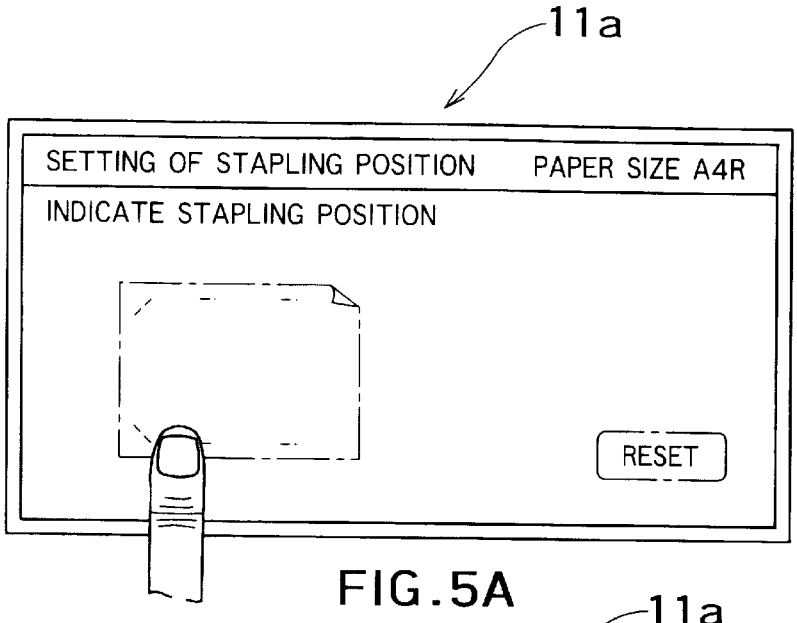
FIGS. 5A through 5C are schematic diagrams for explaining a stapling-position selecting operation in the first preferred embodiment of a picture image forming system according to the present invention.

(7) Then, the operator touches a desired stapling position of the stapling positions, which are displayed on the display part 11*a* of the operating part 11, to select the desired stapling position (S7). The operating part 11 reads one or more selected stapling positions to transmit information indicative thereof to the stapler 13. In this preferred embodiment, the upper left of a vertical original which has been set in a horizontal orientation is the desired stapling position, and the corresponding stapling position of the display part is touched (FIG. 5A).

(8) Then, the display part of the operating part displays one or more stapling positions, which have been selected from the plurality of stapling positions, by flickering. Thus, the operator confirms the stapling positions (S8).

Figure 5B:
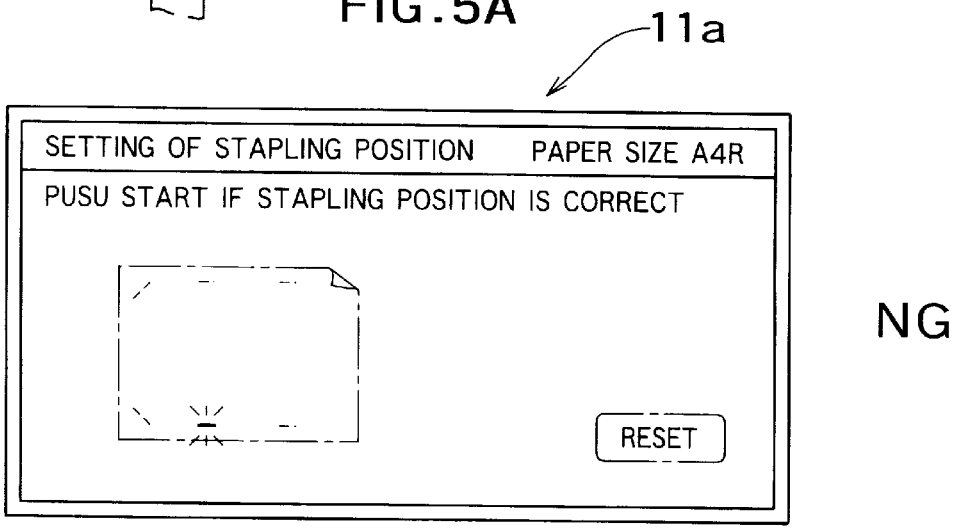
Figure 5C:
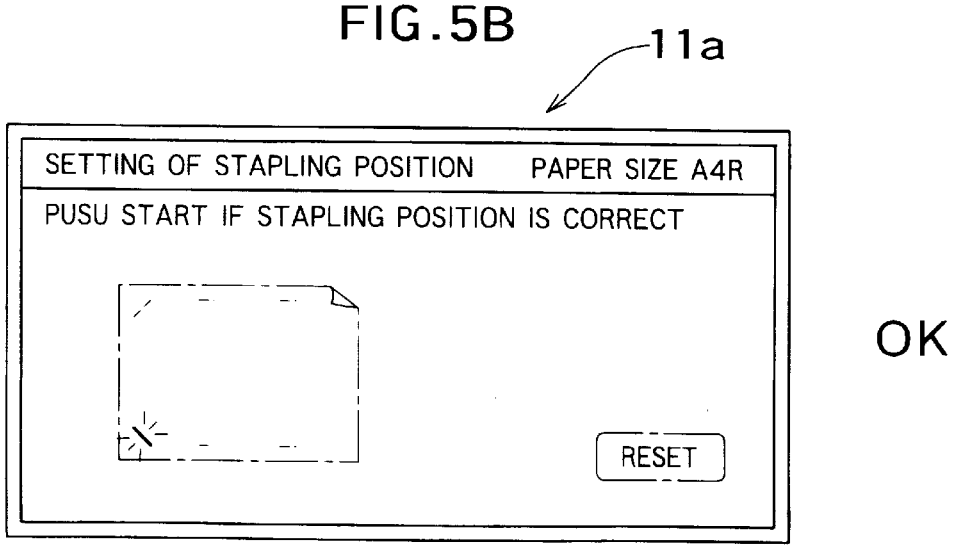

(9) If the flickering stapling position is not coincident with the desired stapling position (FIG. 5B), the previous selection is canceled by activated of a reset key to change the selected stapling position (S9, S10). In the picture image forming system in this preferred embodiment, the reset key is provided on the display part as shown in FIGS. 3 and 5. After the selection is canceled, a stapling position is selected again (S6, S7, S8). If the flickering stapling position is coincident with the desired stapling position (FIG. 5C), the operator activates the start button to start a copying operation (S9, S12).

(10) After the copying operation is completed (S13), the stapler binds a plurality of copied sheets on the basis of the stapling position information (S14).

While the above described stapling-position selecting operation has used the automatic document feeder, it can be similarly carried out in a case where, e.g., 100 copies of a single original are made to be stapled without the need of the automatic document feeder.

Figure 9:
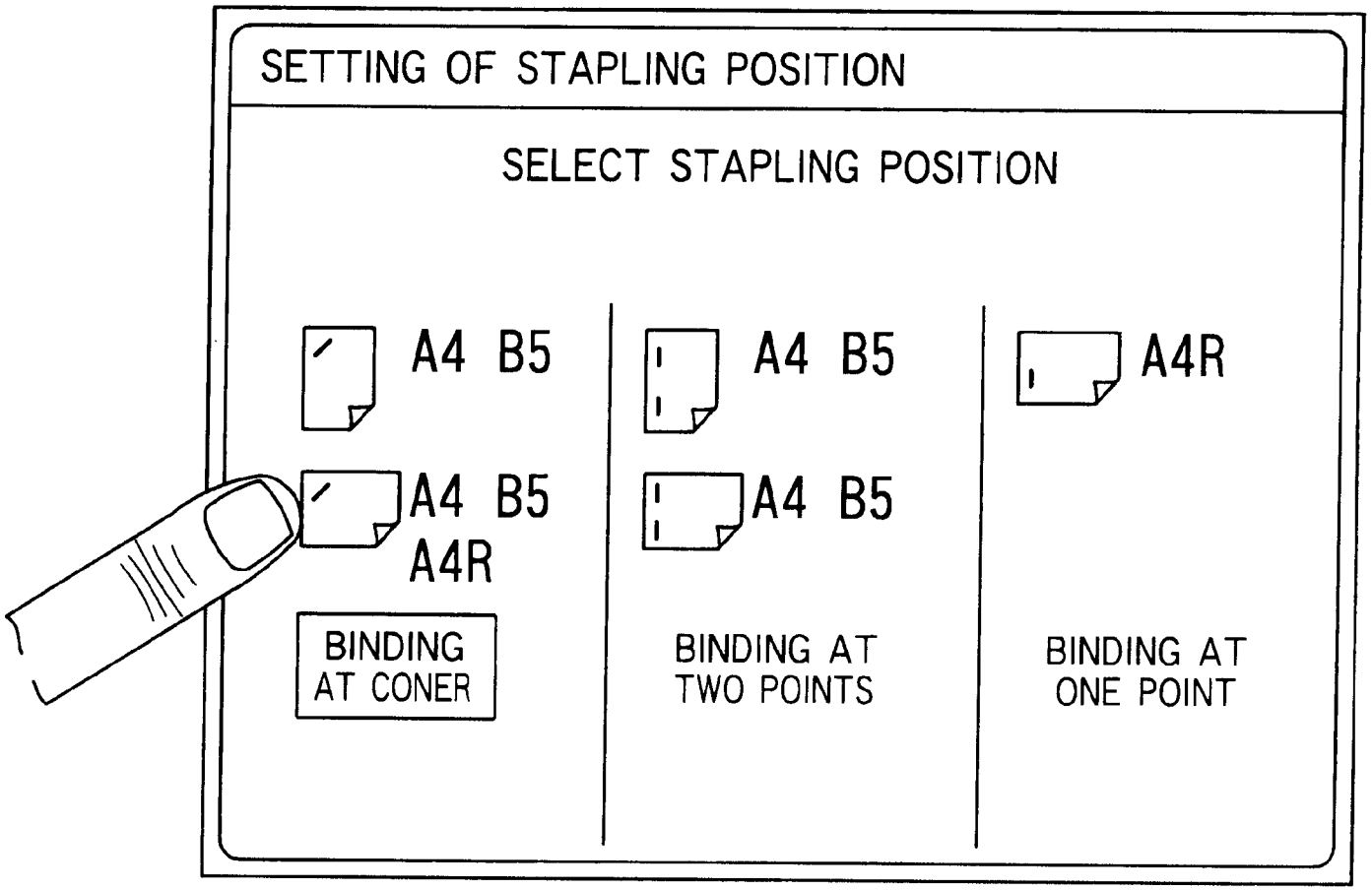
FIG. 9 is a schematic diagram showing an operating part of a conventional picture image forming system.

As described above, since the operating part of the picture image forming system in this preferred embodiment displays the picture image of only one original and displays the stapling positions thereon in layers, the display of the stapling positions is larger and more conspicuous than that of the conventional operating part (FIG. 9). In addition, the picture image forming system in this preferred embodiment is easy to operate since the orientation and size of the original are automatically displayed on the display part. Thus, the picture image forming system in this preferred embodiment can prevent the selection of an erroneous stapling position.

Second Preferred Embodiment

The second preferred embodiment of a picture image forming system according to the present invention is characterized in that a stapling position is decided by a confirmation key provided on an operating part.

Figure 6:
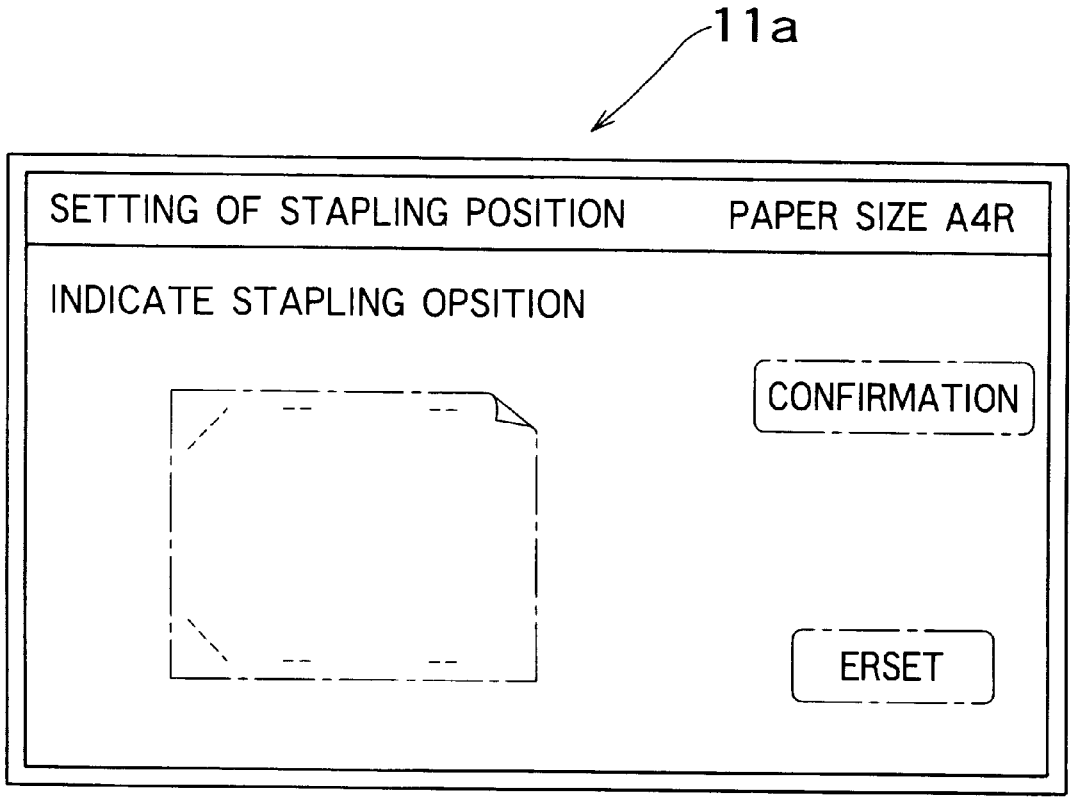
FIG. 6 is a schematic diagram showing a display part of an operating part of the second preferred embodiment of a picture image forming system according to the present invention.
Figure 7:
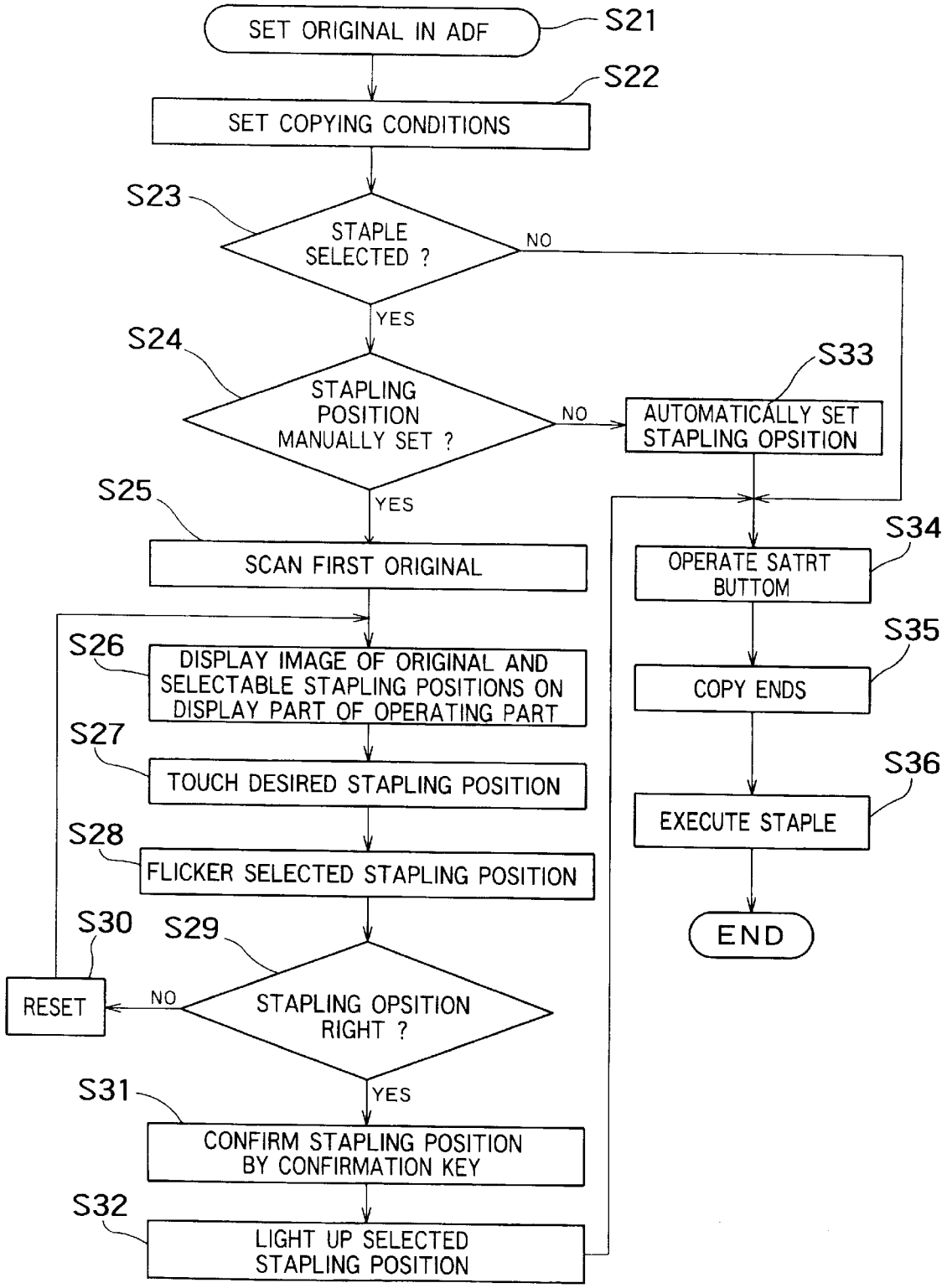
FIG. 7 is a flow chart for explaining a stapling-position selecting operation in the second preferred embodiment of a picture image forming system according to the present invention.

FIG. 6 shows a display part of an operating part of the second preferred embodiment of a picture image forming system according to the present invention. The structure of the picture image forming system in this preferred embodiment is basically the same as that in the first preferred embodiment, except that the confirmation key is provided.

Referring to the flow chart of FIG. 7 and FIGS. 1, 2, 6 and 8, a stapling-position selecting operation in the picture image forming system in the second preferred embodiment will be described below.

(1) First, an original is set in the automatic document feeder (ADF) 12 (S21).

(2) Then, copying conditions, such as the number of sheets to be copied, a scale and the selection of a sorter, are set by the operating part 11 (S22).

(3) When the above described copying conditions are set, whether a stapling operation is intended to be carried out is also selected (S23). When no stapling operation is intended to be carried out, the start button 11*b* is activated to start a copying operation (S34).

(4) Then, the operator selects whether a stapling position is intended to be set manually (S24). If the stapling position is not set manually, the stapling position is set automatically (S33). Thereafter, the start button 11*b* is activated to start a copying operation (S34).

(5) Then, the automatic document feeder 12 takes the first original in, and the image reader of the picture image forming system body 10 reads image data including the orientation and size of the original (S25). This image reader is the same as that used when reading the original during the copying operation, and may be a well-known image reader.

(6) Then, on the basis of the read image data, the picture image of only one original, which includes vertical and horizontal orientations, is displayed on the display part 11*a* of the operating part 11, and a plurality of selectable stapling positions are displayed on the picture image of the original in layers (S26, FIG. 6).

Figure 8A:
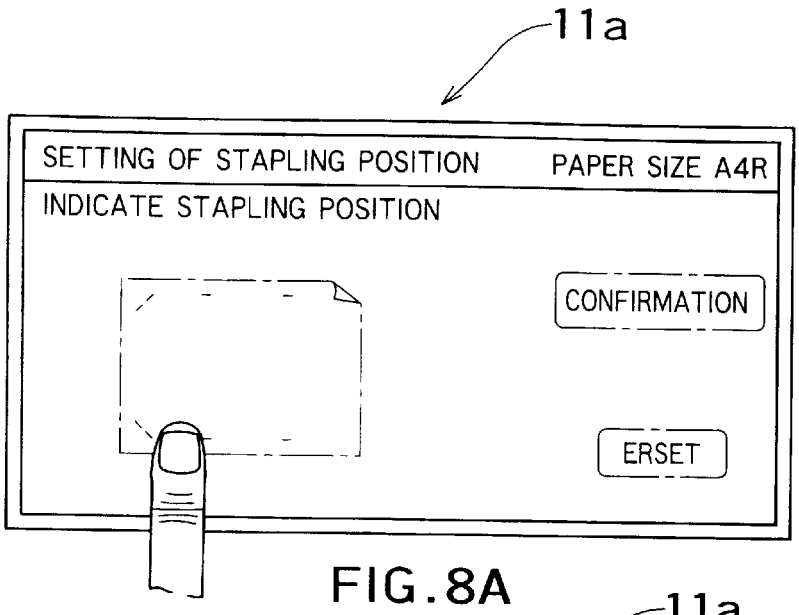
FIGS. 8A through 8C are schematic diagrams for explaining a stapling-position selecting operation in the second preferred embodiment of a picture image forming system according to the present invention.

(7) Then, the operator touches a desired stapling position of the stapling positions, which are displayed on the display part 11*a* of the operating part 11, to select the desired stapling position (S27). The operating part 11 reads one or more selected stapling positions to transmit information indicative thereof to the stapler 13. In this preferred embodiment, the upper left of a vertical original which has been set in a horizontal orientation is a desired stapling position, and the corresponding stapling position of the display part is touched (FIG. 8A).

(8) Then, the display part of the operating part displays one or more stapling positions, which have been selected from the plurality of stapling positions, by flickering. Thus, the operator confirms the stapling position(s) (S28).

Figure 8B:
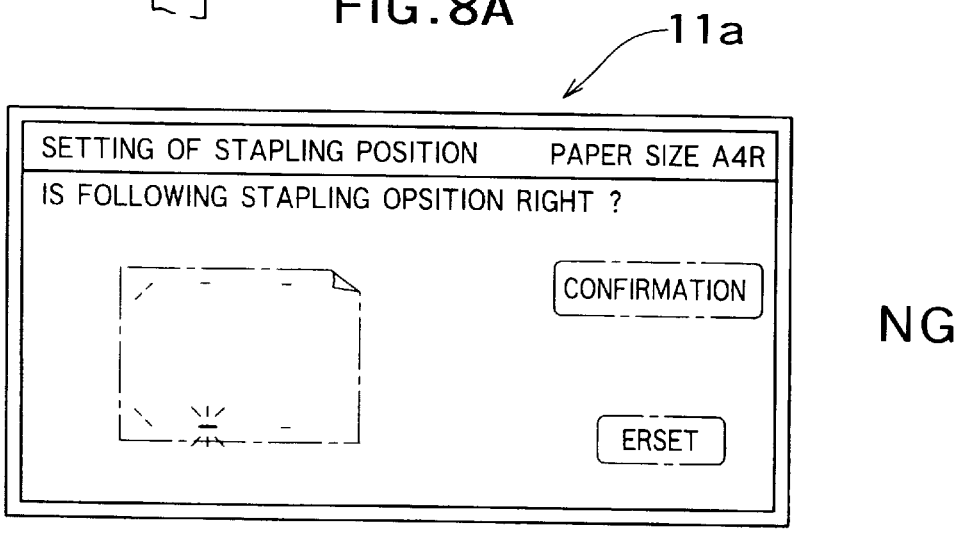
Figure 8C:
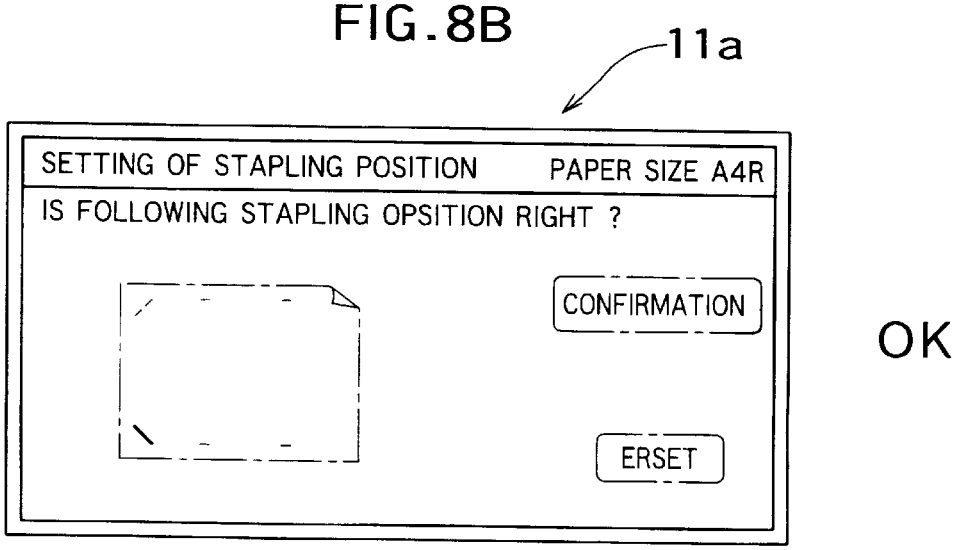

(9) If the flickering stapling position is not coincident with the desired stapling position (FIG. 8B), the previous selection is canceled by activation of a reset key to change the selected stapling position (S29, S30). In the picture image forming system in this preferred embodiment, the reset key is provided on the display part as shown in FIGS. 6 and 8. After the selection is canceled, a stapling position is selected again (S26, S27, S28). If the flickering stapling position is coincident with the desired stapling position (FIG. 8C), the operator confirms the selected position by activating the confirmation key (S31). In the picture image forming system in this preferred embodiment, the confirmation key is provided on the display part as shown in FIGS. 6 and 8.

(10) After the selected position is confirmed, the display of the stapling position on the display part is stops flickering and light up (S32). Then, the operator activates the start button to start a copying operation (S34). Furthermore, a copying operation may be automatically started after the selected position is confirmed with the confirmation key.

(11) After the copying operation is completed (S35), the stapler binds a plurality of copied sheets on the basis of the stapling position information (S14).

As described above, since the operating part of the picture image forming system in this preferred embodiment displays the picture image of only one original and displays the stapling positions thereon in layers, the display of the stapling positions is larger and more conspicuous than that of the conventional operating part (FIG. 9). In addition, the picture image forming system in this preferred embodiment is easy to operate since the orientation and size of the original are automatically displayed on the display part. Thus, the picture image forming system in this preferred embodiment can prevent the selection of an erroneous stapling position.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A picture image forming system comprising:

a picture image forming system body for forming a picture image on the basis of an inputted picture signal and for reading image data including the orientation and size of an original to be copied, using a picture image reader;

an operating part for displaying a picture image of only one type of original so as to include a vertical or horizontal orientation and for displaying a plurality of selectable stapling positions on said picture image of only one type of original in layers, said operating part reading one or more stapling positions selected from said plurality of selectable stapling positions; and a stapler for binding a plurality of copied sheets on the basis of information about the selected stapling positions, said operating part having a confirmation key for confirming the selected stapling position, said picture image forming system body automatically starting a copying operation when the selection of stapling position is confirmed by said confirmation key of said operating part.

2. A picture image forming system as set forth in claim 1, wherein said operating part displays the selected one or more stapling positions of said plurality of stapling positions by flickering.

3. A picture image forming system as set forth in claim 1, wherein said operating part cancels a previous selection by means of a reset key to change the selected one or more stapling positions.

4. A picture image forming system as set forth in claim 1, wherein said operating part displays the selected one or more stapling positions of said plurality of stapling positions in a flickering manner, and the decided stapling positions in a lit up manner.

5. A picture image forming system as set forth in claim 1, which further comprises an automatic document feeder for automatically feeding a plurality of originals to be copied, to said picture image forming system body.

6. A picture image forming system as set forth in claim 1, which further comprises a sorter part having at least one of sorting and stacking functions.

7. A stapling method for use in a picture image forming system, said stapling method comprising:

a first step of reading image data including the orientation and size from an original to be copied, using an image reader of the picture image forming system;

a second step of displaying a picture image of only one type of original so as to include a vertical or horizontal orientation, and of displaying a plurality of selectable stapling positions on said picture image of only one type of original in layers; and a third step of starting a copy operation after confirming the selected stapling position by a confirmation key and stapling a plurality of copied sheets using a stapler on the basis of information about a selected stapling position.

8. A stapling method as set forth in claim 7, wherein said selected stapling position is flickered to confirm said selected stapling position.

* * * * *